United States Patent [19]

Tada et al.

[11] 4,306,207

[45] Dec. 15, 1981

[54] SELF-SUSTAINING SOLENOID

[75] Inventors: Kiichiro Tada; Takao Hasumuro, both of Yao, Japan

[73] Assignee: Hosiden Electronics Co., Ltd., Osaka, Japan

[21] Appl. No.: 147,446

[22] Filed: May 7, 1980

[51] Int. Cl.[3] ..... H01F 7/16

[52] U.S. Cl. ..... 335/234; 335/229

[58] Field of Search ..... 335/234, 230, 229, 231, 335/78, 79, 80, 81, 179, 262

[56] References Cited

U.S. PATENT DOCUMENTS

| | | | |
|---|---|---|---|
| 3,505,628 | 4/1970 | Allen | 335/262 |
| 3,775,714 | 11/1973 | Heuer | 335/230 |
| 4,240,055 | 12/1980 | Shimizu et al. | 335/234 |

*Primary Examiner*—Harold Broome

*Attorney, Agent, or Firm*—Pollock, Vande Sande & Priddy

[57] ABSTRACT

By applying an operating current to an operating coil, a moving iron core disposed in the operating coil is attracted deeply thereinto to butt against a fixed receiver. By applying a return current to a return coil, the moving iron core is pulled away from the fixed receiver. At least one of the moving iron core and the fixed receiver is divided into two parts in the direction of travel of the permanent magnet and a permanent magnet is sandwiched between the two parts to couple them together. The permanent magnet is magnetized by an operating magnetic field set up by the operating current and demagnetized by the return current.

6 Claims, 8 Drawing Figures

SELF-SUSTAINING SOLENOID

BACKGROUND OF THE INVENTION

This invention relates to a self-sustaining solenoid in which a plunger is retracted by a supply of an operating current and held at its retracted position even after cutting off of the operating current and moved back upon application of a return current.

In conventional types of self-sustaining solenoids, when an operating current is applied to a coil, the plunger is attracted into the coil to butt against a permanent magnet fixed to one inner end of the coil and, even after cutting off of the operating current, the plunger is retained on the permanent magnet by its magnetic attractive force. By applying to the coil a current reverse in direction from the operating current to apply to the permanent magnet a magnetic field opposite to the direction of magnetization of the permanent magnet the attractive force of the permanent magnet is reduced and the plunger is pulled out of the coil to its original position, for example, by the force of a return spring imparted to the plunger beforehand.

Since the prior art self-sustaining solenoid has such a construction that during operation the plunger makes direct contact with the permanent magnet as described above, the permanent magnet is liable to be broken. Further, an oxide magnet has been used, as the permanent magnet, which has a relatively large coercive force and a Curie temperature above 450° C. and is difficult of demagnetization. The magnetization of such a permanent magnet is not affected by the application thereto of the magnetic field based on the operating current or return current. Accordingly, when the plunger stays in its restored state, it is likely to be attracted by the permanent magnet if moved a little by mechanical vibration or shock towards the permanent magnet. If the force of the return spring is made large to avoid the possibility of such accidental attraction of the plunger by the permanent magnet, it is necessary to increase the number of turns of a coil for attracting the plunger against the return spring during operation, and further, means for holding the plunger at its restored position inevitably becomes bulky, resulting in the overall size of the device being increased.

It is an object of the present invention to provide a self-sustaining solenoid which is long-lived even if used frequently.

Another object of the present invention is to provide a self-sustaining solenoid which can be constructed small.

Another object of the present invention is to provide a self-sustaining solenoid which stably maintains its restored states even if subjected to mechanical vibration or shock and which can be constructed small.

Yet another object of the present invention is to provide a self-sustaining solenoid which is hardly affected by an ambient temperature change or power source voltage fluctuation.

SUMMARY OF THE INVENTION

According to the present invention, an operating coil and a return coil are provided coaxially and a moving iron core or plunger is disposed inside of the both coils in a manner to be movable along the coil axis. One end of the plunger projects outwardly of the coils and a fixed receiver is disposed in opposing relation to the other end of the plunger. The fixed receiver is coupled with one end of a magnetic yoke, the other end of which is adjacent the peripheral surface of the projecting portion of the plunger. At least one of the plunger and the fixed receiver is divided into two in the direction of the abovesaid coil axis and the two divided members are interlinked with a permanent magnet sandwiched therebetween. As the permanent magnet, use is made of a magnet which can be magnetized and demagnetized relatively easily at room temperature. One of the confronting end faces of the plunger and the fixed receiver has formed therein a projection having a cross-section of a circular truncated cone, and the other end face has a recess having a cross-section of a circular truncated cone for receiving the projection.

By applying an operating current to the operating coil to set up a magnetic field in the plunger and the permanent magnet, and by the magnetic energy of the field, the plunger is attracted to the fixed receiver and the permanent magnet is magnetized. Accordingly, even if the operating current is cut off, the plunger is retained on the permanent magnet by its attractive force. By applying a return current to the return coil to establish in the plunger and the permanent magnet a return magnetic field reverse in direction from the operating magnetic field, and by this return magnetic field, the magnetization of the permanent magnet is demagnetized completely or substantially completely. At this time, the plunger is returned by the return spring or a load, or due to the weight of the plunger itself from the fixed receiver to the original position.

DESCRIPTION OF THE PREFERRED EMBODIMENTS

Figure 1:
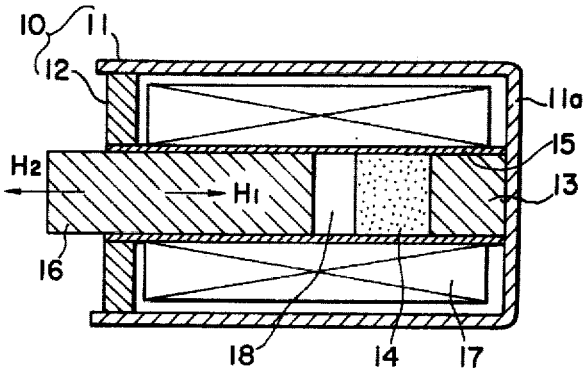
FIG. 1 is a cross-sectional view illustrating the construction of a conventional self-sustaining solenoid.

To facilitate a better understanding of the present invention, a description will be given of a conventional self-sustaining solenoid. FIG. 1 illustrates the construction of the self-sustaining solenoid heretofore employed. A magnetic yoke 10 is composed of a yoke proper 11 formed by bending a magnetic plate to have a U-shaped cross-section and a coupling portion 12 coupling together both ends of the yoke proper 11. A columnar, fixed receiver 13 is fixed to the central portion of an intermediate portion 11*a* of the yoke 11 to extend in its axial direction, and a columnar permanent magnet 14 of the same diameter as the fixed receiver 13 is mounted on the free end face thereof. A cylindrical member 15 made as of copper is disposed so that its one end portion encompasses the fixed receiver 13. The other end portion of the cylindrical member 15 is inserted into a centrally disposed hole of the yoke coupling portion 12. A columnar, moving iron core or a so-called plunger 16 of substantially the same diameter as the fixed receiver 13 is inserted into the cylindrical member 15 in a manner to be slidable along its axis. A coil 17 is wound around the cylindrical member 15. Though not illustrated, the moving iron core 16 is biased as by a return spring in such a direction as to be pulled out of the magnetic yoke 10 and is received by a stopper; in this state, an air gap 18 is defined by the moving iron core 16 and the permanent magnet 14 therebetween.

In the prior art self-sustaining solenoid of such a construction, during operation an operating current of a predetermined direction is applied by some means (not shown) to the coil 17 to establish therein a magnetic field $H_1$ of the same direction as the direction of magnetization of the permanent magnet 14. By the magnetic energy of the magnetic field $H_1$, the moving iron core 16 is moved into contact with the permanent magnet 14.

In this state, even if the operation current to the coil 17 is cut off, the moving iron core 16 is held on the permanent magnet 14 by its magnetic attraction. To disconnect the moving iron core 16 from the permanent magnet 14, a return current is provided to the coil 17 in a direction reverse from the operating current. This return current sets up in the coil 17 a magnetic field $H_2$ opposite in direction from the direction of magnetization of the permanent magnet 14. By this magnetic field $H_2$, the attractive force of the permanent magnet 14 for the moving iron core 16 is decreased or reduced to zero, with the result that the moving iron core 16 is pulled by a return spring (not shown) away from the permanent magnet 14 to the initial position.

In the conventional self-sustaining solenoid, the permanent magnet 14 is liable to be broken since the moving iron core 16 butts directly against the permanent magnet 14. Further, when the air gap 18 exceeds a certain value, the permanent magnet 14 abruptly decreases its attractive force and does not sufficiently attract the moving iron core 16. On top of that, the magnetomotive force of the coil 17 varies with a voltage fluctuation and a temperature change, resulting in the attraction and return characteristics undergoing a substantial change in some cases. Hence, the prior art solenoid is not practical.

To obviate these shortcomings, there has been proposed a solenoid which employs, as the permanent magnet 14, for example, an oxide magnet of large magnetic force and a specially-designed magnetic circuit; however, the permanent magnet 14 becomes bulky, and consequently the manufacturing cost of the solenoid rises naturally. Moreover, since the oxide magnet used in this kind of solenoid is usually large in coercive force and is difficult of demagnetization, the permanent magnet 14 remains magnetized when the return current to the coil 17 is cut off. Accordingly, when the moving iron core 16 held in its returned position is moved as by mechanical vibration towards the permanent magnet 14 even slightly, the core 16 is likely to be easily attracted by the attractive force of the permanent magnet 14. To avoid this, it is necessary in the prior art to use a return spring of relatively large force. Therefore, during operation the moving iron core 15 must be moved against the large force of the return spring; this requires an increased operating current and an increased number of turns of the coil 17. As a consequence, the coil 17 and means for holding the core 16 at its returned position inevitably become bulky.

Figure 2:
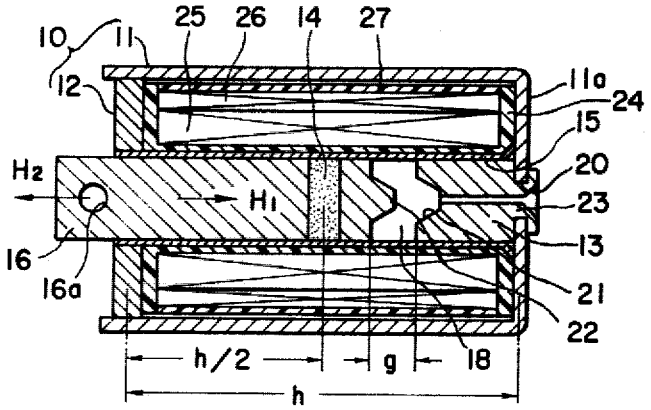
FIG. 2 is a cross-sectional view showing the construction of an embodiment of the self-sustaining solenoid of this invention.

FIG. 2 illustrates the construction of an embodiment of the self-sustaining solenoid of the present invention, in which parts corresponding to those in FIG. 1 are identified by the same reference numerals. Though not particularly referred to in connection with FIG. 1, the fixed receiver 13 is secured to the magnetic yoke proper 11 in the following manner: A small hole 23 is made in an intermediate portion of the yoke proper 11 at the center thereof; a support tube 20 is formed integrally with the fixed receiver 13 to project out centrally thereof on the side of the intermediate portion 11*a* of the yoke proper 11; the support tube 20 is inserted into the small hole 23; and the projecting end portion of the support tube 20 is spread out in its radial direction to stake the fixed receiver 13 to the intermediate portion 11*a* of the yoke proper 11. The small hole 23 is formed to extend through the fixed receiver 13 along its axis so that air may easily enter into or go out of the air gap when the moving iron core 16 is moved.

In the illustrated embodiment, the moving iron core 16 is split into two in its lengthwise direction, and these two core elements are interlinked with the permanent magnet 14 sandwiched therebetween. The permanent magnet 14 has a coercive force which is $\frac{1}{3}$ to $\frac{1}{4}$ of that of the permanent magnet employed in the conventional self-sustaining solenoid; and the magnet 14 can be magnetized, at room temperature, by a magnetic field of the magnetomotive force by a coil of this kind of solenoid usually employed in the prior art and can readily be demagnetized by a magnetic field opposite in direction from the abovesaid magnetic field. This permanent magnet is possible of repeated magnetization and demagnetization. As this magnet, use can be made of Alnico having a residual magnetic flux Br of 12.5 to 13.3 KG and a coercive force Hc of 700 to 630 Oe. The projecting end of the moving iron core 16 has formed therein a through hole 16*a* for connection with a load.

The end face of the moving iron core 16 on the side of the stationary receiver 13 has formed therein a projection 23 of a V-shaped cross-section including the axis of the core 16. The end face of the fixed receiver 13 opposing the V-shaped projection 22 has formed therein a V-shaped recess 21 for receiving the V-shaped projection 22. With such an arrangement, the contact area of the moving iron core 16 with the fixed receiver 13 increases, by which the attractive force of the moving iron core 16 can be increased. Letting the distance between the intermediate portion 11*a* of the yoke proper 11 and the coupling portion 12 be represented by h, the distance between the coupling portion 12 and the permanent magnet 14 in the state of the moving iron core 16 being held in its projecting position is selected to be h/2.

Figure 3:
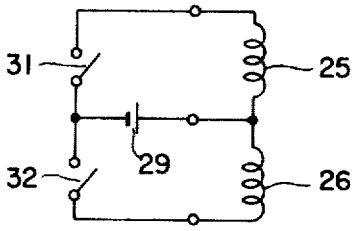
FIG. 3 is a circuit diagram showing the electrical connection of an operating coil and a return coil used in the embodiment of FIG. 2.
Figure 4:
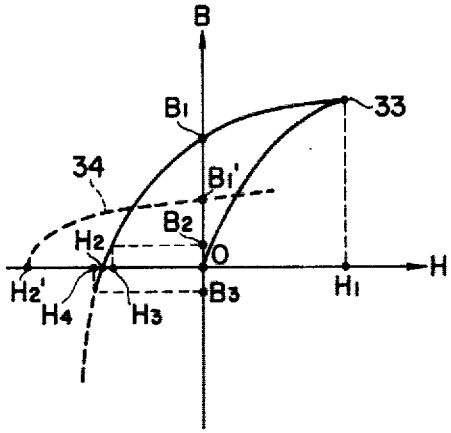
FIG. 4 is a graph showing the flux-field characteristic of a permanent magnet employed in the self-sustaining solenoid of this invention.
Figure 5:
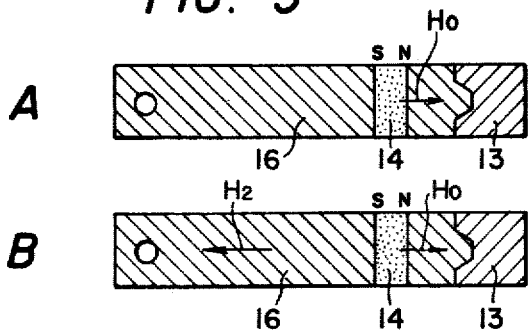
FIGS. 5A and 5B are diagrams showing the relationships of an applied magnetic field, the magnetic field of the permanent magnet, a moving iron core and a fixed receiver to one another, explanatory of the operation of the embodiment depicted in FIG. 2.

In the present embodiment, a bobbin 24 is mounted on the cylindrical member 15 and an operating coil 25 is wound on the bobbin 24 and, further, a return coil 26 is wound on the operating coil 25. The return coil 26 is covered with a tape 27. While in use, the operating coil 25 and the return coil 26 are connected to a power source 29, for example, as shown in FIG. 3. The both coils 25 and 26 are interconnected at one end and connected to one end of the power source 29, and the other ends are connected to the other end of the power source 29 via switches 31 and 32 respectively. The directions of winding of the coils 25 and 26 are selected so that magnetic fields which are induced by turning ON the switches 31 and 32 may be reverse in direction from each other. In the example of FIG. 3, the coils 25 and 26 are wound in the same direction and currents are applied to them in opposite directions. In the operation of the solenoid, when turning ON the switch 31, an operating current flows therethrough in the operating coil 25 to set up in the cylindrical member 15 a magnetic field $H_1$ substantially parallel with its axis. The magnetic field $H_1$ passed through a closed magnetic path [magnetic yoke 10—fixed receiver 13—moving iron core 16]. By the magnetic energy of this closed magnetic path, the moving iron core 16 is moved towards the fixed receiver 13 to butt against it. Further, by the magnetic field $H_1$, the permanent magnet 14 is magnetized; in this state, even if the operating current is cut off, the permanent magnet 14 retains residual magnetization $B_1$ in accordance with its B-H characteristic curve shown in FIG. 4. In FIG. 4, the abscissa represents magnetic field H and the ordinate magnetic flux B. Before the operating current is supplied, the magnetic field H is zero and the magnetic flux B of the permanent magnet 14 is also zero. Upon application of the operating current, the magnetic field $H_1$ occurs and moves on the characteristic curve to a point 33; thereafter, when the magnetic field H is reduced to zero by cutting off the operating current, the magnetic flux B assumes a value $B_1$ and the permanent magnet 14 is magnetized. Accordingly, as shown in FIG. 5A, the moving iron core 16 is attracted by the magnetic force $H_0$ of the permanent magnet 14 towards the stationary receiver 13 and is then retained thereon.

For returning the moving iron core 16 to its original position, the switch 32 is turned ON. A return current flows via the switch 32 to the return coil 26 to establish in the cylindrical member 15 a magnetic field $H_2$ which is parallel with its axis and opposite in direction to the magnetic field $H_1$. The magnetic field $H_2$ is reverse in direction from the magnetic force $H_1$ of the permanent magnet 14, as depicted in FIG. 5B, and removes the residual magnetism of the permanent magnet 14. Accordingly, even if the force of the return spring is very weak, the moving iron core 16 is pulled away from the fixed receiver 13 to the initial position. In this case, if the solenoid is used with the direction of movement of the moving iron core 16 held downward, the core 16 is returnd by the weight of its own or a load coupled therewith, and consequently no return spring is needed.

The value $H_2$ of the magnetic field for returning the moving iron core 16 may undergo some changes under the influence of a temperature change or voltage fluctuation. For example, in the case where the value of the magnetic field for core returning use is $H_3$ ($|H_3| < |H_2|$), a residual magnetic flux $B_2$ remains in the permanent magnet 14, as shown in FIG. 4, but since the attractive force based on this residual flux is weak, the moving iron core can easily be returned to its original position by imparting thereto a weak returning force only enough to overcome the above attractive force. In the case where the magnetic field for core returning use is $H_4$ ($|H_2| < |H_4|$), a residual magnetic flux $B_3$ remains in the permanent magnet 14, but since the residual magnetic flux is reverse in polarity from the residual magnetic flux $B_1$, the residual magnetic flux density becomes zero when the polarity of the residual magnetic flux is inverted, and at this time, the moving iron core 16 returns to its original position. Since the magnetomotive force necessary for returning the core 16 may be about $\frac{1}{4}$ of the magnetomotive force for the operation of the solenoid, the number of turns of the return coil 26 may be smaller than the number of turns of the operating coil 25.

The self-sustaining solenoid of the present invention employs, as the permanent magnet, for example, Alnico which is magnetized by a relatively weak magnetic field at room temperature and is easily demagnetized, as referred to previously. The coercive force of Alnico is in the range of $\frac{1}{3}$ to $\frac{1}{4}$ of the coercive force of a permanent magnet used in the prior art, for example, an example, an oxide magnet. The demagnetization of the oxide magnet heretofore employed is very difficult and requires heating up to a high temperature above the Curie temperature (450° C.). However, the permanent magnet for use in the present invention can easily be magnetized and demagnetized repeatedly by applying the operating current and the return current to the operating coil and the return coil at room temperature. In general, it is desired that ordinary permanent magnets have a large coercive force $H_2'$ as indicated by the broken line curve 34 in FIG. 4, but it is apparent that it is desirable in the present invention to use a permanent magnet of small coercive force $H_2$ but high residual flux density $B_1$.

As described above, in the self-sustaining solenoid of the present invention, use is made of the permanent magnet 14 which can easily be magnetized and demagnetized repeatedly by the supply of the operating current and the return current, and the moving iron core 16 and the fixed receiver 13 respectively have formed therein the V-shaped projection 22 and the V-shaped recess 21 so as to provide for increased area of contact therebetween; consequently, a strong attractive force is obtained and the solenoid is stably self-sustained by the permanent magnet 14 which is magnetized by the magnetomotive force which is yielded by the operating current. It is most effective to insert the permanent magnet 14 in the moving iron core 16 at the central position of the magnetic yoke 10 in its lengthwise direction in the state of the moving iron core 16 being retained at its original position, as shown in FIG. 2.

Figure 6:
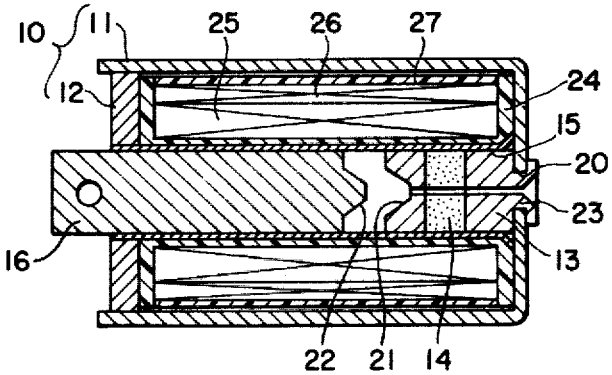
FIG. 6 is a cross-sectional view illustrating the construction of another embodiment of the self-sustaining solenoid of this invention.

FIG. 6 illustrates the construction of another embodiment of the self-sustaining solenoid of the present invention, which differs from the embodiment of FIG. 2 only in the position of the permanent magnet 14. In the present embodiment, the fixed receiver 13 is split into two in a plane perpendicular to its axis and the permanent magnet 14 is disposed therebetween. Since this embodiment is identical with the embodiment of FIG. 2 in the other constructions and in operation, no detailed description will be repeated. The self-sustaining solenoid of the present invention is not limited specifically to the abovesaid two embodiments; for example, the operating coil 25 and the return coil 26 need not always be wound concentrically but may also be wound on the cylindrical member 15 in side-by-side relation. Also it is possible to make one or the entire part of either the operating coil 25 or the returning coil 26 perform the function of the other. In such a case, the magnetic field $H_1$ for operation and the magnetic field $H_2$ for core returning use are obtained by reversing the direction of the current applied to the coil and adjusting its magnitude. The magnetic yoke 10 may also be formed cylindrical.

As described above in detail, in the self-sustaining solenoid of the present invention, since the permanent magnet 14 is inserted in the intermediate portion of either the moving iron core 16 or the fixed receiver 13 in its axial direction, the moving iron core 16 does not directly strike against the permanent magnet 14 and hence is hardly broken; namely, this construction ensures to prolong the life of the moving iron core 16. As the permanent magnet 14, use is made of such a magnet that can easily be magnetized or demagnetized by the magnetic field resulting from the operating current or return current which is applied to the operating coil 25 or the return coil 26; that is, the permanent magnet 14 can accurately be controlled by a relatively small current and the moving iron core 16 can stably be held in its attracted state. Further, since the moving iron core 16 and the fixed receiver 13 respectively the V-shaped projection and the V-shaped recess for engagement with each other, a strong attractive force is yielded during operation and stable self-sustaining of the solenoid is also achieved. Moreover, since the permanent magnet 14 is magnetized by the operating current and demagnetized by the return current, the moving iron core 16 is smoothly returned by a small return current. Furthermore, since the permanent magnet 14 is demagnetized during returning of the moving iron core 16, even if the return spring is weak, there is no fear of such an erroneous operation that the moving iron core 16 is attracted by the permanent magnet 14 when subjected to mechanical vibration. Therefore, the return spring may also be small and the overall size of the device can be reduced.

Figure 7:
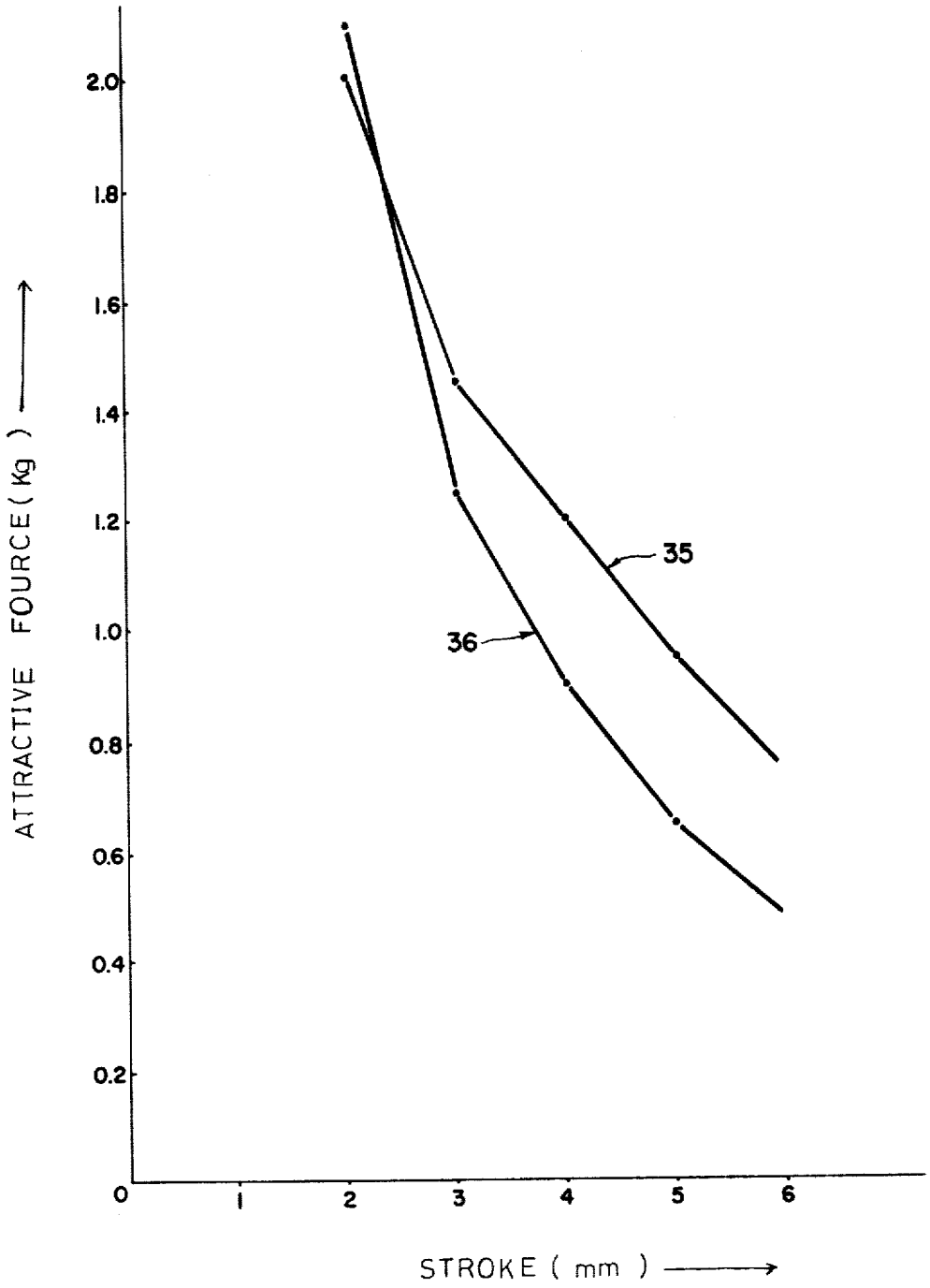
FIG. 7 is a graph showing the relationship of the gap between the moving iron core and the fixed receiver to the attractive force of the permanent magnet acting on the moving iron core.

FIG. 7 shows the results of comparison in the attractive force between the self-sustaining solenoids respectively shown in FIGS. 6 and 2. These solenoids were of the same configuration; the operating coil had 600 turns of a 0.47 mm diameter polyurethane coated wire and a resistance value of 3.5 Ω; the return coil had 830 turns of a 0.23 mm diameter polyurethane coated wire and a resistance value of 27 Ω; the moving iron core was 12 mm in diameter; Alnico was used as the permanent magnet; a DC voltage of 9.5 V was applied; the residual magnetism after demagnetization was less than 20 gr in the solenoid of FIG. 6 and 150 gr in the solenoid of FIG. 2. In FIG. 7, the abscissa represents the gap g between the moving iron core 16 and the stationary receiver 13 and the ordinate the attractive force F acting on the moving iron core 16. The curve 35 indicates the case of the solenoid of FIG. 6 and the curve 36 indicates the case of the solenoid of FIG. 2. It is understood from these curves that as the gap g between the moving iron core 16 and the fixed receiver 13 increases, the attractive force in the solenoid of the present invention becomes large as compared with the attractive force obtained in the solenoid of FIG. 2. Accordingly, in the case of the attractive force being provided in the both solenoids, the stroke of the moving iron core 16 can be increased in the solenoid of the present invention; conversely, in the case of the same stroke, the solenoid of the present invention can be used with a larger load, and in the case of the same stroke and the same load, the number of turns of the operating coil and/or the operating current can be reduced.

It will be apparent that many modifications and variations may be effected without departing from the scope of the novel concepts of this invention.

What is claimed is:

1. A self-sustaining solenoid comprising:

an operating coil and a return coil wound coaxially about the same straight line;

a moving iron core disposed in the coil assembly with one end portion of the core projecting out of one end thereof and adapted to be movable on the straight line;

a fixed receiver disposed at the other end of the coil assembly for receiving the moving iron core when it is pulled into the coil assembly;

a magnetic yoke coupled at one end with the fixed receiver and disposed at other end adjacent the peripheral surface of that portion of the moving iron core projecting out of the coil assembly;

a projection formed in one of confronting end faces of the moving iron core and the fixed receiver;

a recess formed in the other one of the confronting end faces of the moving iron core and the fixed receiver for receiving the projection; and a permanent magnet inserted in at least one of the moving iron core and the fixed receiver in a manner to divide it into two in the direction of the straight line but couple together the divided portions, the permanent magnet being magnetized by an operating magnetic field set up by an operating current supplied to the operating coil and substantially completely demagnetized by a return magnetic field established by a return current supplied to the return coil.

2. A self-sustaining solenoid according to claim 1, wherein the permanent magnet is inserted in the moving iron core and lies substantially midway between the both ends of the magnetic yoke when the moving iron core is held apart from the fixed receiver.

3. A self-sustaining solenoid according to claim 1, further comprising a cylindrical member made of a non-magnetic material and disposed in the coil assembly for receiving the moving iron core inserted thereinto at one end thereof, the fixed receiver being disposed at the other end of the cylindrical member.

4. A self-sustaining solenoid according to claim 1, wherein the operating coil and the return coil are disposed coaxially.

5. A self-sustaining solenoid according to claim 1, wherein the operating coil and the return coil are disposed side by side on the straight line.

6. A self-sustaining solenoid according to claim 1, wherein one part or the entire part of the operating coil is made to perform the functions of the operating coil and the return coil.

* * * * *